United States Patent [19]

Mohr

[11] Patent Number: 4,606,975

[45] Date of Patent: Aug. 19, 1986

[54] PROCESS FOR THE TWO-STAGE ANODIC OXIDATION OF ALUMINUM BASES FOR OFFSET PRINTING PLATES AND PRODUCT THEREOF

[75] Inventor: Dieter Mohr, Schlangenbad, Fed. Rep. of Germany

[73] Assignee: Hoechst Aktiengesellschaft, Frankfurt am Main, Fed. Rep. of Germany

[21] Appl. No.: 634,550

[22] Filed: Jul. 26, 1984

[30] Foreign Application Priority Data

Aug. 3, 1983 [DE] Fed. Rep. of Germany ..... 3328048

[51] Int. Cl.[4] ..... C25D 11/12; B41N 1/04; B41C 1/10

[52] U.S. Cl. ..... 428/469; 101/463.1; 204/27; 204/33; 204/38.3; 204/42; 204/58; 430/278

[58] Field of Search ..... 204/17, 27, 28, 33, 204/38 A, 42, 58; 428/469, 701, 702; 101/463.1; 430/278

[56] References Cited

U.S. PATENT DOCUMENTS

| | | | |
|---|---|---|---|
| 3,511,661 | 5/1970 | Rauner et al. | 430/278 |
| 3,594,289 | 7/1971 | Watkinson et al. | 202/103 |
| 3,836,437 | 9/1974 | Osada et al. | 204/117 |
| 3,945,899 | 3/1976 | Nikaido et al. | 204/181.2 |
| 3,960,676 | 6/1976 | Miyosawa et al. | 204/38.3 |
| 4,188,270 | 2/1980 | Kataoka | 204/42 |
| 4,211,619 | 7/1980 | Usbeck | 264/33 |

FOREIGN PATENT DOCUMENTS

| | | |
|---|---|---|
| 0007233 | 1/1980 | European Pat. Off. . |
| 0007234 | 1/1980 | European Pat. Off. . |
| 0008212 | 2/1980 | European Pat. Off. . |
| 3206470 | 9/1983 | Fed. Rep. of Germany . |
| 3312497 | 10/1984 | Fed. Rep. of Germany . |
| 1410768 | 10/1975 | United Kingdom . |
| 1412929 | 11/1975 | United Kingdom . |
| 1523030 | 8/1978 | United Kingdom . |
| 1587260 | 4/1981 | United Kingdom . |
| 2088901 | 6/1982 | United Kingdom . |

*Primary Examiner*—John F. Niebling
*Assistant Examiner*—William T. Leader
*Attorney, Agent, or Firm*—Schwartz, Jeffery, Schwaab, Mack, Blumenthal & Evans

[57] ABSTRACT

Disclosed is a base for offset printing plates in the form of a sheet, a foil or a web and a process for producing same which includes the steps of chemically, mechanically and/or electrochemically roughening aluminum or one of its alloys, and forming an oxide layer by means of a two-stage anodic oxidation in (a) an aqueous electrolyte which comprises phosphorus-containing anions and (b) an aqueous electrolyte based on sulfuric acid. A $H_3PO_4$-free electrolyte comprising dissolved phosphoroxo anions is employed in the first stage. Also disclosed are an offset printing plate and a process for producing same.

12 Claims, No Drawings

PROCESS FOR THE TWO-STAGE ANODIC OXIDATION OF ALUMINUM BASES FOR OFFSET PRINTING PLATES AND PRODUCT THEREOF

BACKGROUND OF THE INVENTION

The present invention relates to an aluminum base for offset printing plates and to a two-stage anodic oxidation process for production of the base. Also disclosed is the offset printing plate itself and the process for producing same.

Bases for offset printing plates are provided, either directly by the user or by the manufacturer of precoated printing plates, with a radiation-sensitive or photosensitive layer (reproduction layer) on one or both sides, with the aid of which layer a printable image is produced by photomechanical means. After production of a printing form from the printing plate, the base carries the image areas which convey ink during subsequent printing and, in the areas which are image-free during subsequent printing (non-image areas), also forms the hydrophilic image background for the lithographic printing process.

Bases for reproduction layers for the production of offset printing plates therefore have to meet the following requirements:

The areas of the radiation-sensitive layer which are relatively more soluble after exposure must be capable of being readily removed from the base without leaving a residue to produce the hydrophilic non-image areas, this being done without the developer attacking the base to any great extent.

The base bared in the non-image areas must have a great affinity for water, i.e. must be very hydrophilic, in order to take up water rapidly and permanently and to have a sufficiently repellant action toward the fatty printing ink as required in the lithographic printing process.

The adhesion of the photosensitive layer before exposure, and of the printing areas of the layer after exposure, must be adequate.

The base should possess good mechanical stability, for example to abrasion, and good chemical resistance, in particular to alkaline media.

A particularly frequently used starting material for such bases is aluminum, the surface of which is roughened by conventional methods, by drybrushing, wetbrushing, sand blasting, chemical treatment and/or electrochemical treatment. To increase the abrasion-resistant, electrochemically roughened substrates, in particular, are subjected to an anodizing step to build up a thin oxide layer. These anodic oxidation processes are usually carried out in electrolytes such as $H_2SO_4$, $H_3PO_4$, $H_3BO_3$, amidosulfonic acid, sulfosuccinic acid, sulfosalicylic acid or mixtures of these. The oxide layers produced in these electrolytes or mixtures of electrolytes differ in structure, layer thickness and resistance to chemicals. In offset printing plate production in practice, in particular an aqueous $H_2SO_4$ or $H_3PO_4$ solution is employed. With regard to $H_2SO_4$-containing electrolytes, reference may be made to, for example, U.S. Pat. No. 4,211,619 and the prior art mentioned therein.

Aluminum oxide layers produced in aqueous $H_2SO_4$-containing electrolytes are amorphous and, when used in offset printing plates, usually have a weight per unit area of about 0.5 to 10 g/m$^2$, corresponding to a layer thickness of about 0.15 to 3.0 $\mu$m. The disadvantage of using such an anodically oxidized base for offset printing plates is the face that the oxide layers produced in $H_2SO_4$ electrolytes have a relatively low resistance to alkaline solutions as used to an increasing extent in, for example, the processing of presensitized offset printing plates, preferably in modern developer solutions for irradiated negative-working or, in particular, positive-working radiation-sensitive layers.

The anodic oxidation of aluminum in aqueous electrolytes containing phosphorus oxyacids or phosphates is likewise known per se:

U.S. Pat. No. 3,511,661 describes a process for the production of a lithographic printing plate, in which the aluminum base is oxidized anodically at a temperature of at least 17° C. in an at least 10% strength aqueous $H_3PO_4$ solution, until the aluminum oxide layer has a thickness of at least 50 nm.

U.S. Pat. No. 3,594,289 discloses a process in which a printing plate base made of aluminum is oxidized anodically in a 50% strength aqueous $H_3PO_4$ solution at a current density of 0.5 to 2.0 A/dm$^2$ and at a temperature of 15° to 40° C.

The process for the anodic oxidation of aluminum bases, in particular for printing plates, according to U.S. Pat. No. 3,836,437 is carried out in a 5 to 50% strength aqueous $Na_3PO_4$ solution at a temperature of 20° to 40° C. and a current density of 0.8 to 3.0 A/dm$^2$ and for a period of 3 to 10 minutes. The aluminum oxide layer thus produced should have a weight of 10 to 200 mg/m$^2$.

The aqueous bath for the electrolytic treatment of aluminum which is to be coated subsequently with a water-soluble or water-dispersible sustance contains, according to U.S. Pat. No. 3,960,676, 5 to 45% of silicates, 1 to 2.5% of permanganates, or borates, phosphates, chromates, molybdates or vanadates in an amount from 1% to saturation.

British Pat. No. 1,587,260 discloses a base for printing plates which carries an oxide layer which is produced by anodic oxidation of aluminum in an aqueous solution of $H_3PO_3$ or a mixture of $H_2SO_4$ and $H_3PO_3$. The resulting relatively porous oxide layer is then covered with a second oxide film of the "barrier layer" type, which can be formed, for example, by anodic oxidation in aqueous solutions containing boric acid, tartaric acid or borates. Both the first stage (Example 3, 5 min) and the second stage (Example 3, 2 min) are carried out very slowly, and furthermore the second stage is carried out at a relatively high temperature (80°).

It is true that an oxide layer produced in these electrolytes is often more resistant to alkaline media than is an oxide layer produced in an electrolyte based on $H_2SO_4$ solution. This oxide layer while having some other advantages, such as a paler surface, better water-/ink balance or less absorption of dyes ("staining") in the non-image areas), also possesses significant disadvantages. In a modern manufacturing line for the production of printing plate bases, it is possible, using voltages and residence times conforming to practice, to produce oxide layers having a weight per unit area of, for example, only up to about 1.5 g/m$^2$, which corresponds to a layer thickness which, of course, provides less protection from mechanical abrasion than does a thicker oxide layer produced in an $H_2SO_4$ electrolyte. Because of the relatively large pore volume and pore diameter of an oxide layer produced in $H_3PO_4$, the mechanical stability of the oxide itself is lower; this results in a further loss with respect to abrasion-resistant.

Processes have also been disclosed which seek to combine the advantages of both electrolytes by employing a two-stage treatment procedure.

The process for the production of aluminum printing plate bases according to British Pat. No. 1,410,768 is carried out as follows: the aluminum is first oxidized anodically in an $H_2SO_4$-containing electrolyte. This oxide layer is thereafter treated in a 5 to 50 vol % aqueous $H_3PO_4$ solution, in the absence of an electric current. The actual oxide layer should have a weight per unit area of 1 to 6 g/m$^2$, this weight decreases significantly during immersion in the aqueous $H_3PO_4$ solution, for example by about 2 to 3 g/m$^2$ per minute of immersion time for an aqueous $H_3PO_4$ solution. Electrochemical treatment in the $H_3PO_4$ solution (Example 11) and the use of a mixed electrolyte consisting of $H_3PO_4/H_2SO_4$ (Example 12) are also said to be possible, with loss of oxide layer occurring in these cases, too.

A two-stage electrochemical treatment, first in an electrolyte based on $H_2SO_4$ and then in an electrolyte based on $H_3PO_4$, is also described in U.S. Pat. No. 3,940,321. In the two-stage anodic oxidation or treatment procedure, the oxide layer built up in the $H_2SO_4$ electrolyte once again is redissolved to an excessive extent in the $H_3PO_4$ solution under the conventional conditions.

Occasionally, procedures for carrying out certain surface modifications even before the anodic oxidation in $H_2SO_4$ solutions have also been described, for example:

U.S. Pat. No. 4,278,737 describes an electrolysis in a bath containing borate ions carried out prior to the anodic oxidation in a second bath (for example an aqueous $H_2SO_4$ solution); the pH value of the first bath should be 9 to 11 and the treatment temperature 50° to 80° C., the thickness of the first layer should be at least 2 μm, and that of the second layer should be greater (for example, about 20 μm).

British Pat. No. 1,523,030 describes an electrolysis in an aqueous solution consisting of a salt (such as a borate or phosphate) and, if appropriate, an acid or a salt for producing a barrier layer (for example, boric acid or ammonium borate).

However, both publications relate only to aluminum which is intended to be used for window frames, panels (wainscots) and fixing components for building structures or decorative aluminum moldings for vehicles or domestic articles. Moreover, the formation of relatively thin layers would mean that these could become too easily detached again in the second treatment.

In British Pat. No. 1,412,929, an aluminum surface is treated with hot water or steam (with the formation of a boehmite layer), after which electrolysis is carried out in an aqueous solution of a salt of silicic, phosphoric, molybdic, vanadic, permanganic, stannic or tungstic acid. This treatment is intended to produce greater layer thickness, improved toughness, a finer structure and hence greater corrosion-resistance (for example, to acids or alkali). U.S. Pat. No. 3,945,899 also describes a similar process, wherein the surface of the aluminum can be, not only in the form of a boehmite layer, but also in the form of a chemically "modified layer", as the result of a chromate or phosphate treatment. In the Examples, the duration of electrolysis is from 2 to 10 minutes. However, both treatment steps are too protracted for modern manufacturing lines, and furthermore, the non-electrolytically produced aluminum layers do not conform very well to the practical requirements which high-performance printing plates have to meet (for example, in respect to the abrasion-resistance and the interactions with the photosensitive layer).

In European Pat. No. 0,007,233 and No. 0,007,234, aluminum bases for printing plates are anodically oxidized in such a way that they run, as an intermediate conductor, first through a bath containing aqueous 45% strength $H_3PO_4$ and an anode, and then into a bath containing aqueous 15% strength $H_2SO_4$ and a cathode. The two electrodes can also be connected to an a.c. voltage source. It is also stated (although no further specifications are given) that the treatment with $H_3PO_4$ can be purely a dip treatment, and that it would also be possible to use neutral or alkaline solutions instead of the acids.

German Offenlegungsschrift No. 32 06 470 which has not been previously published and has an earlier priority date describes a two-stage oxidation process for the production of bases for offset printing plates in which the anodic oxidation is carried out in (a) an aqueous electrolyte based on sulfuric acid and (b) an aqueous electrolyte containing phosphoroxo, phosphorfluoro and/or phosphoroxofluoro anions. Another publication, German Offenlegungsschrift No. 33 12 497, which has not been published previously and has an earlier priority date likewise describes such a two-stage process. In this process, however, anodic oxidation is carried out first in an electrolyte containing phosphoric acid and only then in an electrolyte containing sulfuric acid.

British Pat. No. 20 88 901 discloses a two-stage anodic oxidation process for printing plate bases made of aluminum, wherein an aqueous electrolyte containing $H_3PO_4$ is employed in the first stage, and an aqueous electrolyte containing $H_2SO_4$ and $H_3PO_4$ is employed in the second stage. In the first stage, the solution employed contains at least 250 g of $H_3PO_4$ per liter.

Monitoring a bath in the case of a mixed electrolyte is always difficult and expensive, so that the use of mixed electrolytes is avoided to the extent possible in modern manufacturing lines. The use of relatively high concentrations of $H_3PO_4$ has, if anything, proved to be disadvantageous owing to the pronounced redissolution effects; this also applies to the use of a.c. current in the two-stage anodization. Connecting both electrodes to a current source can also be disadvantageous, since such a variant is more difficult to control from the point of view of production engineering.

Oxide layers produced initially in $H_3PO_4$-containing aqueous electrolytes are known to form a relatively compact barrier layer, which helps to increase the alkali-resistance of the oxide and hence to protect the aluminum underneath. However, in a subsequent treatment in $H_2SO_4$-containing aqueous electrolytes, a compact barrier layer of this type can often be, if anything, troublesome, since its electrical resistance first has to be overcome, and high voltages are therefore required. As a result, there is an increased danger of the occurrence of "burn-outs", i.e. penetration through the initially formed oxide layer. These burn-outs are unacceptable with regard to use in the lithography field.

SUMMARY OF THE INVENTION

It is therefore an object of the present invention to provide a process for increasing the alkali-resistance of bases for offset printing plates based on roughened and anodically oxidized aluminum, which can be carried out rapidly and without great expense in a modern manufacturing line.

Another object of the present invention is the provision of a process of the type described above in which the extent of redissolution of oxide is low, or redissolution does not occur at all, and the advantageous property of the oxide layer, which is conventionally achieved in anodic oxidation in an aqueous $H_2SO_4$ solution is retained.

Yet another object of the invention is the provision of a process as described above having high chemical stability.

In accomplishing the foregoing objects, there has been provided according to one aspect of the present invention a process for the production of bases for offset printing plates in the form of sheets, foils or webs, comprising the steps of chemically, mechanically and/or electrochemically roughening a base material comprising aluminium or one of its alloys, anodically oxidizing the base material by a two-stage procedure involving a first anodic oxidation stage in (a) an aqueous electrolyte comprising phosphorus-containing anions and a second anodic oxidation stage in (b) an aqueous electrolyte comprising sulfuric acid, wherein the stage (a) is carried out in an $H_3PO_4$ free aqueous electrolyte comprising dissolved phosphoroxo anions, for a period of about 1 to 60 seconds, at a voltage between about 10 and 100 volts at a temperature of about 10° to 80° C. Preferably, stage (a) is carried out for a period of about 5 to 60 seconds, at a voltage between about 20 and 80 volts and at a temperature of about 15° to 60° C.

In accordance with another aspect of the present invention there has been provided a base for offset printing plates in the form of a sheet, a foil or a web produced by the process described above.

In accordance with yet another aspect of the present invention there has been provided a process for producing an offset printing plate, comprising the steps of chemically, mechanically and/or electrochemically roughening a base material comprising aluminum or one of its alloys, anodically oxidizing the base material by a two-stage procedure involving a first anodic oxidation stage in (a) an aqueous electrolyte comprising phosphorus-containing anions and a second anodic oxidation stage (b) in an aqueous electrolyte comprising sulfuric acid, wherein stage (a) is carried out in an $H_3PO_4$-free aqueous electrolyte comprising dissolved phosphoroxo anions, for a period of about 1 to 60 seconds, at a voltage between about 10 and 100 volts and at a temperature of about 10° to 80° C., coating the anodically oxidized base material with a radiation-sensitive or photosensitive material, imagewise exposing or irradiating the coated base material, and washing out the nonimage areas with a developer.

In accordance with still yet another aspect of the present invention there has been provided an offset printing plate produced by the process described immediately above.

Further objects, features and advantages of the present invention will become apparent from the detailed description of preferred embodiments which follows.

DETAILED DESCRIPTION OF PREFERRED EMBODIMENTS

The present invention is based on a process for the production of bases for offset printing plates in the form of sheets, foils or webs from chemically, mechanically and/or electrochemically roughened aluminum or one of its alloys by means of a two-stage anodic oxidation in (a) an aqueous electrolyte other than $H_3PO_4$ comprising phosphorus-containing anions and then in (b) an aqueous electrolyte comprising sulfuric acid. In the process according to the invention, stage (a) is carried out in an aqueous electrolyte comprising dissolved phosphoroxo anions, with the exception of an aqueous $H_3PO_4$ electrolyte, for a period of about 1 to 60 seconds, at a voltage between about 10 and 100 volts and at a temperature of about 10° to 80° C.

In a preferred embodiment of the process according to the present invention, stage (a) is carried out for a period of about 5 to 60 seconds, at a voltage between about 20 and 80 volts and at a temperature of about 15° to 60° C.

The aqueous electrolyte with the stated content of phosphoroxo anions preferably includes a salt having the corresponding anion, in particular a salt having an alkali metal, alkaline earth metal or ammonium cation and a phosphoroxo anion. It is also possible to employ acids, preferably oligo- and polyphosphoric acids. The concentration of the aqueous electrolyte can be varied within wide limits, but is preferably between about 5 and 500 g/l, in particular between about 10 and 200 g/l. Examples of suitable compounds in the electrolytes are:

sodium dihydrogen phosphate, $NaH_2PO_4$
disodium hydrogen phosphate, $Na_2HPO_4$
trisodium phosphate, $Na_3PO_4$
phosphorous acid, $H_3PO_3$
disodium phosphite, $Na_2HPO_3$
diphosphoric acid (pyrophosphoric acid), $H_4P_2O_7$
sodium pyrophosphate, $Na_4P_2O_7$
triphosphoric acid, $H_5P_3O_{10}$
sodium triphosphate, $Na_5P_3O_{10}$
polyphosphoric acid, $H_{n+2}P_nO_{3n+1}$
hexasodium tetrapolyphosphate, $Na_6P_4O_{13}$
hexasodium metaphosphate, $Na_6(PO_3)_6$ As used herein, the term "phosphoroxo anions" is intended to refer to anions comprising one or more atoms of phosphorus bonded to oxygen atoms as in the foregoing example compounds.

When phosphoroxo anions, with the exception of $Na_3PO_4$, are used, the alkali-resistance of the layers produced by the process according to the present invention remains in general—fairly independently of the electrolyte concentration—within similar orders of magnitude, taking the times in the zincate test as a basis. The current curve for the anodization has approximately the following characteristics: the initial current density remains at about 18 to 25 A/dm$^2$ for a very short time, and after as short a time as about 2 to 5 sec the current density decreases to values below about 10 A/dm$^2$, and then drops towards zero after about 10 to 20 sec. Where $Na_3PO_4$ is used, depending on the applied voltage a constant current density of about 5 to 20 A/dm$^2$ is maintained for the duration of the anodization. $Na_3PO_4$ constitutes an exception to a certain extent also with regard to the alkali-resistance of the oxide layers produced with it, since an increase in the electrolyte concentration also leads to a substantial increase in the times obtained in the zincate test. The use of higher voltages also results, in general, in an increase in the alkali-resistance of the layers.

Suitable base materials for oxidation according to the present invention include those comprising aluminum or one of its alloys which comprises, for example, more than 98.5% by weight of Al and proportions of Si, Fe, Ti, Cu and Zn. These aluminum base materials are first cleaned, if necessary, and then roughened mechanically (for example, by brushing and/or by treatment with abrasives), chemically (for example, by means of etching agents) and/or electrochemically (for example, by treatment with a.c. current in aqueous HCl, $HNO_3$ or salt solutions). In the process according to the invention, the materials used are, in particular, those which have been roughened electrochemically or by a combination of mechanical and electrochemical means. All process stages can be carried out batchwise, but are preferably carried out continuously.

In general, the process parameters in the roughening stage are in the following ranges, particularly in the case of the continuous procedure: the temperature of the electrolyte is between about 20° and 60° C., the active compound (acid or salt) concentration is between about 2 and 100 g/l (or higher in the case of salt), the current density is between about 15 and 250 A/dm$^2$, the residence time is between about 3 and 100 sec and the flow rate of the electrolyte at the surface of the article to be treated is between about 5 and 100 cm/sec. The type of current used is generally a.c. current, but it is also possible to employ modified types of current, such as a.c. current with different current amplitudes for the anode current and cathode current. In this procedure, the average peak-to-valley height, $R_z$, of the roughened surface is in the range from about 1 to 15 μm. The peak-to-valley height is determined in accordance with DIN 4768 in the version of October 1970, and is defined as the arithmetic mean of the individual peak-to-valley heights of five individually measured areas lying adjacent to one another.

Precleaning comprises, for example, treatment with aqueous NaOH solution, with or without degreasing agents and/or complex formers, trichloroethylene, acetone, methanol or other commercial so-called aluminum pickles.

The roughening step can be followed by an additional, etching treatment, whereby, in particular, a maximum of 2 g/m$^2$ is removed. If there are several roughening stages, etching treatment can also be carried out between the individual stages, with up to about 5 g/m$^2$ being removed between the stages. The etching solutions used are, in general, aqueous alkali metal hydroxide solutions or aqueous solutions of alkaline salts or aqueous acid solutions based on $HNO_3$, $H_2SO_4$ or $H_3PO_4$. In addition to an etching treatment stage between the roughening stage and the anodization stages, non-electrochemical treatments are also known which merely have a rinsing and/or cleaning action and are useful, for example, for removing deposits ("smut") formed during the roughening process or simply for removing residual electrolyte, for example, dilute aqueous alkali metal hydroxide solutions or water are used for these purposes.

The roughening process is then followed by the first anodic oxidation stage, stage (a) described above, which constitutes one of the further process stages. A rinsing stage can be performed before stage (b). Stage (b) is carried out in an electrolyte containing $H_2SO_4$, as described at the outset in the assessment of the prior art. In addition to the principal ingredients $H_2SO_4$ and water, a suitable electrolyte will also include $Al^{3+}$ ions, which are either formed during the process or added at the outset, for example, in the form of $Al_2(SO_4)_3$. In particular, the electrolyte in stage (b) contains about 100 to 250 g/l of $H_2SO_4$ and at least about 5 g/l of $Al^{3+}$ ions, and the procedure is carried out at about 20° to 60° C. For the anodic oxidation in these stages, it is preferable to use d.c. current, but a.c. current or a combination of these types of current, for example, d.c. current superposed with a.c. current can also be employed. The duration of the process in both stages in preferably about 5 to 60 seconds. The weights per unit area of the oxide layer produced in stage (a) vary in general between about 0.4 and 1.4 g/m$^2$, corresponding to a layer thickness of about 0.01 to 0.4 μm; but preferably, about 0.6 to 1 g/m$^2$, corresponding to about 0.02 to 0.3 μm. This oxide layer is rinsed with water, if necessary, and then further treated in stage (b), in which the weight per unit area of oxide can be increased to values of, for example, about 1 to 3 g/m$^2$ (corresponding to 0.3 to 1 μm). The aluminum oxide layers also contain $Al_2(SO_4)_3$ and $AlPO_4$.

The stages of anodic oxidation of the aluminum base material can also be followed by one or more post-treatment stages, although these are often unneccessary, particularly in the present process. Post-treatment is understood as meaning, in particular, a chemical or electrochemical treatment of the aluminum oxide layer to render it hydrophilic, for example, treatment of the material by immersion in an aqueous polyvinylphosphonic acid solution in accordance with German Pat. No. 16 21 478 (=British Pat. No. 1,230,447), treatment by immersion in an aqueous alkali metal silicate solution in accordance with German Auslegeschrift No. 14 71 707 (=U.S. Pat. No. 3,181,461) or an electrochemical treatment (anodization) in an aqueous alkali metal silicate solution in accordance with German Offenlegungsschrift No. 25 32 769 (=U.S. Pat. No. 3,902,976). In these post-treatment stages, in particular, the hydrophilicity of the aluminum oxide layer, which is frequently already sufficient, is increased further, the remaining conventional properties of this layer being at least retained.

The materials produced according to the present invention are used as bases for offset printing plates, i.e. a radiation-sensitive coating is applied on one or both sides of the base material, either by the manufacturer of presensitized printing plates or directly by the user. Suitable radiation-sensitive or photosensitive layers are, in principle, all layers which, after irradiation (exposure), with or without subsequent development and/or fixing, give an imagewise surface which can be used for printing.

In addition to the silver halide-containing layers used in many fields, various other layers are also known, as described in, for example, "Light-Sensitive Systems" by Jaromir Kosar, published by John Wiley & Sons, New York 1965: colloid layers containing chromates and dichromates (chapter 2); layers containing unsaturated compounds, and in which these compounds undergo isomerization, rearrangement, cyclization or crosslinking on exposure (Kosar, chapter 4); layers containing photopolymerizable compounds and in which monomers or prepolymers undergo polymerization on exposure, if appropriate with the aid of an initiator (Kosar, chapter 5); and layers containing o-diazoquinones, such as diazonaphthoquinones, p-diazoquinones or diazonium salt condensates (Kosar, chapter 7). Suitable layers also include the electrophotographic layers, i.e. those which contain an inorganic or organic photoconductor. In addition to the photosensitive substances, these layers can, of course, also contain other components, such as, for example, resins, dyes or plasticizers. In particular, the following photosensitive compositions or compounds can be employed in coating the bases produced by the process according to the invention:

positive-working reproduction layers which are described in, for example, German Pat. No. 854,890; No. 865,109; No. 879,203; No. 894,959; No. 938,233; No. 1,109,521; No. 1,144,705; No. 1,118,606; No. 1,120,273; No. 1,124,817 and No. 2,331,377 and European Pat. No. 0,021,428 and No. 0,055,814, and which contain, as the photosensitive compound, o-diazoquinones, in particular o-diazonaphthoquinones, such as 2-diazo-1,2-naphtoquinonesulfonic acid esters or amides, which can be low molecular weight or high molecular weight;

negative-working reproduction layers containing condensation products of aromatic diazonium salts and compounds possessing active carbonyl groups, preferably condensation products of diphenylaminediazonium salts and formaldehyde, which are described in, for example, German Pat. No. 596,731; No. 1,138,399; No. 1,138,400; No. 1,138,401; No. 1,142,871 and No. 1,154,123; U.S. Pat. No. 2,679,498 and No. 3,050,502 and British Pat. No. 712,606;

negative-working reproduction layers, for example as described in German Pat. No. 20 65 732, which contain co-condensation products of aromatic diazonium compounds, the layers containing products which contain at least one unit each of (a) a condesnable aromatic diazonium salt compound and (b) a condensable compound such as a phenol ether or an aromatic thioether, bonded through a divalent bridge member, such as a methylene group, which is derived from a condensable carbonyl compound;

positive-working layers as described in German Offenlegungsschrift No. 26 10 842, German Pat. No. 27 18 254 or German Offenlegungsschrift No. 29 28 636, which contain a compound which splits off acid on exposure, a monomeric or polymeric compound which possesses at least one C—O—C group which can be split off by means of an acid (for example, an orthocarboxylate group or a carboxamidoacetal group), and, if appropriate, a binder;

negative-working layers comprising photopolymerizable monomers, photoinitiators, binders and, if appropriate, further additives; the monomers used are, for example, acrylates and methacrylates or reaction products of diisocyanates with partial esters of polyhydric alcohols, as described in, for example, U.S. Pat. Nos. 2,760,863 and 3,060,023 and German Offenlegungsschrift No. 20 64 079 and 23 61 041; and negative-working layers as described in German Offenlegungsschrift No. 30 36 077, which comprise, as the photosensitive compound, a diazonium salt polycondensation product or an organic azido compound and, as the binder, a high molecular weight polymer possessing alkenylsulfonyl or cycloalkenylsuflfonylurethane side groups.

Photosemiconducting layers as described in, for example, German Pat. No. 11 17 391, No. 15 22 497, No. 15 72 312, No. 23 22 046 and No. 23 22 047 can also be applied onto the bases produced according to the present invention to produce highly photosensitive electrophotographic printing plates.

The coated offset printing plates obtained from the bases produced by the process according to the present invention are converted to the desired printing form in a known manner, by imagewise exposure or irradiation and washing out of the non-image areas with a developer, for example an aqueous alkaline developer solution. Surprisingly, offset printing plates whose base materials have been treated by the process according to the present invention are distinguished by substantially improved resistance to alkalis compared with those plates in which the same base material has been treated without employing stage (a). In addition, the bases produced according to the present invention, or the offset printing plates or printing forms produced from them have the following characteristics:

the "burn-outs" which are observed when $H_3PO_4$ is used in stage 8a) do not occur in the process according to the present invention, the alkali-resistance of the oxide layer, which is observed when $H_3PO_4$ is used in stage (a), is substantially improved according to the present invention, particularly where salts are used, the alkali-resistance which can be observed when salts possessing phosphoroxo anions are used in stage (b), i.e. in a reversal of the process according to the present invention, is additionally improved while the thickness of the oxide layer remains virtually the same, compared with a procedure in which salts possessing phosphoroxo anions are used in stage (b) (reversal), the hydrophilicity of the surface is improved to such an extent that additional hydrophilizing may be superfluous, and the advantages achieved in reverse processes, such as good abrasion-resistance, a pale surface, the absence of "staining", and excellent water/ink balance, are at least retained.

In the above description and the examples below, percentages denote percentages by weight, unless stated otherwise. Parts by weight bear the same relation to parts by volume as that of g to $cm^3$. Otherwise, the following methods have been used in the examples in order to test the alkali-resistance of the surface, and the results of the particular examples have been summarized in tables.

ZINCATE TEST (according to U.S. Pat. No. 3,940,321, columns 3 and 4, lines 29 to 68 and lines 1 to 8):

The rate of dissolution, in sec, of an aluminum oxide layer in an alkaline zincate solution is taken as a measure of the alkali-resistance of the layer. The longer the layer requires for dissolution, the geater is its resistance to alkalis. The layer thickness should be roughly comparable since, of course, they also constitute a parameter with regard to the dissolution rate. A drop of a solution of 480 g of KOH and 80 g of zinc oxide in 500 ml of distilled water is applied to the surface to be investigated, and the time which elapses before the appearance of metallic zinc is determined, this being recognizable from the dark coloration which appears at the point being investigated.

GRAVIMETRICALLY DETERMINED CORROSION RATE

A sample of defined size which is protected on the reverse side by means of a surface coating film is agitated in a bath which contains an aqueous solution containing 6 g/l of NaOH. The weight loss suffered in this bath is determined gravimetrically. Times of 1, 2, 4 or 8 minutes are chosen as treatment times in the alkaline bath.

COMPARATIVE EXAMPLE V1

A mill-finished aluminum sheet which is 0.3 mm thick is degreased using an aqueous alkaline pickling solution at a temperature of 50° to 70° C. Electrochemical roughening of the aluminum surface is carried out using a.c. current in an $HNO_3$-containing electrolyte, and a surface roughness having an $R_z$ value of about 6 μm is obtained. Subsequent anodic oxidation is carried out in accordance with the process described in European Pat. No. 0,004,569, in an aqueous electrolyte containing $H_2SO_4$ and $Al_2(SO_4)_3$ to produce a weight per unit area of the oxide layer of 2.8 g/m$^2$.

EXAMPLE 1

An aluminum sheet roughened and pickled as described in Comparative Example V1 is oxidized anodically at room temperature, at a d.c. voltage of 40 V and in an aqueous solution containing 100 g/l of $Na_3PO_4$ for 30 sec. After it has been rinsed with fully deionized water, the sheet is likewise oxidized anodically for 30 seconds at 20 V in a second stage containing an aqueous solution of 200 g/l of $H_2SO_4$ and 50 g/l of $Al_2(SO_4)_3$. Determination of the oxide weight gives a value of 1.3 g/m$^2$. Further results and process variations are given in Table I.

The produce an offset printing plate, this base is coated with the following negative-working photosensitive solution:

0.70 part by weight of a polycondensation product of 1 mole of 3-methoxydiphenylamine-4-diazonium sulfate and 1 mole of 4,4'-bismethoxymethyldiphenyl ether, precipitated as mesitylenesulfonate,
3.40 parts by weight of 85% strength phosphoric acid,
3.00 parts by weight of a modified epoxy resin obtained by reacting 50 parts by weight of an epoxy resin having a molecular weight of below 1000 and 12.8 parts by weight of benzoic acid in ethylene glycol monomethyl ether in the presence of benzyltrimethylammonium hydroxide,
0.44 part by weight of finely milled Heliogen blue G (C.I. 74 100),
62.00 parts by volume of ethylene glycol monomethyl ether,
30.60 parts by volume of tetrahydrofuran, and
8.00 parts by volume of butyl acetate.

Following exposure through a negative mask, development is carried out using a solution of
2.80 parts by weight of $Na_2SO_4.10H_2O$,
2.80 parts by weight of $MgSO_4.7H_2O$,
0.90 part by weight of 85% strength phosphoric acid,
0.08 part by weight of phosphorous acid,
1.60 parts by weight of a non-ionic wetting agent,
10.00 parts by weight of benzyl alcohol,
20.00 parts by weight of n-propanol, and
60.00 parts by weight of water.

The printing plate can be developed rapidly and without staining. The pale appearance of the surface of the base results in very good contrast between image areas and non-image areas. The print run for the printing form is 200,000.

EXAMPLE 2

An aluminum web prepared as described in Example 1 and oxidized anodically by a two-stage procedure is coated with the following positive-working photosensitive solution in order to produce an offset printing plate:

6.00 parts by weight of cresol-formaldehyde novolak (having a softening range from 105° to 120° C. according to DIN 53 181),
1.10 parts by weight of 4-(2-phenylprop-2-yl)-phenyl 2-diazo-1,2-naphthoquinone-4-sulfonate,
0.81 part by weight of polyvinylbutyral,
0.75 part by weight 2-diazo-1,2-naphthoquinone-4-sulfonyl chloride,
0.08 part by weight of crystal violet, and
91.36 part by weight of a solvent mixture comprising 4 parts by volume of ethylene glycol monomethyl ether, 5 parts by volume of tetrahydrofuran and 1 part by volume of butyl acetate.

The coated web is dried in a drying tunnel at temperatures up to 120° C. The printing plate produced in this manner is exposed through a photographic positive and developed with a developer of the following composition:

5.30 parts by weight of sodium metasilicate.$9H_2O$,
3.40 parts by weight of trisodium phosphate.$12H_2O$,
0.30 part by weight of sodium dihydrogen phosphate (anhydrous), and
91.00 parts by weight of water.

The printing form obtained has satisfactory copying and printing properties and possesses very good contrast after expousre. The print run is 150,000.

COMPARATIVE EXAMPLE V2

An aluminum sheet roughened and pckled as described in Comparative Example V1 is oxidized anodically for 30 seconds at room temperature at a d.c. voltage of 40 volts and in an aqueous solution containing 100 g/l of $H_3PO_4$. After it has been rinsed with fully deionized water, the sheet is subjected to a second anodic oxidation as described in Example 1. Under the conditions of Example 1, no current flow is detectable, and the anodization reaction begins abruptly only when the voltage is increased to 35–40 volts. When the second anodization stage is complete, this sheet clearly exhibits burn-outs in the surface. The weight per unit area of the oxide layer is 0.75 g/m$^2$.

EXAMPLES 3 TO 8

An aluminum sheet, pickled and roughened electrochemically as described in Comparative Example V1, is treated anodically in the aqueous electrolyte solution listed in Table I, d.c. voltage being used. Furthermore, the treatment parameters likewise given in Table I are used. Subsequent anodization is then carried out in a second stage, in an $H_2SO_4$-containing electrolyte, as described in Example 1.

EXAMPLES 9 TO 29

An aluminum sheet, pickled and roughened electrochemically, as described in Comparative Example V1 is treated anodically in the aqueous electrolyte solutions listed in Table II, d.c. voltage being used. Furthermore, the treatment parameters likewise given in Table II are used. Subsequent anodization is then carried out in second stage, in an $H_2SO_4$-containing electrolyte, as described in Example 1.

TABLE I

| Example | Electrolyte | Electrolyte solution in stage (a) Concentration (g/l)/ temperature in °C. | Times, in sec, in the zincate test under the process conditions 20 C 10 sec | 20 C 30 sec | 20 C 60 sec | 40 V 10 sec | 40 V 30 sec | 40 V 60 sec | 60 V 10 sec | 60 V 30 sec | 60 V 60 sec | Residence time (min) for the gravimetrically determined corrosion rate(+) 1 | 2 | 4 | 8 |
|---|---|---|---|---|---|---|---|---|---|---|---|---|---|---|---|
| V 1 | — | — | | | | | with out stage (a): 29 | | | | | 1.6 | 2.5 | 3.3 | 4.7 |
| V 2 | $H_3PO_4$ | 100/25 | 58 | 73 | 84 | 93 | 118 | 125 | 127 | 153 | 164 | 0.2 | 0.6 | 0.7 | 1.1 |
| 1 | $Na_3PO_4$ | 100/25 | 116 | 151 | 165 | 184 | 224 | 238 | 256 | 281 | 293 | 0.2 | 0.4 | 1.2 | 2.3 |
| 3 | $Na_3PO_4$ | 100/40 | 124 | 158 | 171 | 198 | 231 | 245 | 268 | 293 | 299 | 0.1 | 0.3 | 0.7 | 0.9 |
| 4 | $Na_3PO_4$ | 100/60 | 133 | 149 | 163 | 196 | 218 | 230 | 272 | 283 | 289 | 0.2 | 0.4 | 0.6 | 1.2 |
| 5 | $Na_3PO_4$ | 150/25 | 94 | 119 | 131 | 163 | 201 | 221 | 253 | 274 | 278 | | | | |
| 6 | $Na_3PO_4$ | 20/25 | 64 | 98 | 113 | 91 | 156 | 172 | 171 | 198 | 205 | | | | |
| 7 | $Na_3PO_4$ | 10/25 | 62 | 87 | 117 | 89 | 144 | 161 | 153 | 168 | 174 | | | | |
| 8 | $Na_3PO_4$ | 150/25 | 114 | 158 | 163 | 177 | 218 | 235 | 248 | 280 | 289 | | | | |

(+) Stage (b) is carried at 40 V/30 sec

TABLE II

| Example | Electrolyte | Electrolyte solution in stage (a) Concentration (g/l) | Times (sec) in the zincate test under the process conditions 20 V/ 30 sec/ 25° C. | 40 V/ 30 sec/ 25° C. | 60 V/ 30 sec/ 25° C. |
|---|---|---|---|---|---|
| 9 | $NaH_2PO_4$ | 100 | 88 | 143 | 175 |
| 10 | $Na_2HPO_4$ | 100 | 108 | 172 | 198 |
| 11 | $H_4P_2O_7$ | 20 | 66 | 113 | 145 |
| 12 | $Na_4P_2O_7$ | 20 | 84 | 129 | 152 |
| 13 | " | 50 | 89 | 134 | 159 |
| 14 | " | 100 | 88 | 126 | 151 |
| 15 | $H_5P_3O_{10}$ | 20 | 53 | 73 | 98 |
| 16 | $Na_5P_3O_{10}$ | 10 | 82 | 136 | 187 |
| 17 | " | 20 | 90 | 142 | 199 |
| 18 | " | 50 | 93 | 137 | 193 |
| 19 | $H_n(PO_3)_n$ | 20 | 69 | 86 | 116 |
| 20 | $Na_6P_4O_{13}$ | 20 | 76 | 108 | 149 |
| 21 | " | 50 | 91 | 105 | 144 |
| 22 | " | 100 | 78 | 98 | 137 |
| 23 | $Na_6(PO_3)_6$ | 20 | 87 | 104 | 145 |
| 24 | " | 50 | 92 | 136 | 184 |
| 25 | " | 100 | 78 | 118 | 143 |
| 26 | $H_3PO_3$ | 20 | 64 | 89 | 128 |
| 27 | $Na_2HPO_3$ | 20 | 93 | 132 | 167 |
| 28 | " | 50 | 82 | 123 | 149 |
| 29 | " | 100 | 75 | 118 | 136 |

EXAMPLE 30

A base which has been treated using a voltage of 60 V for 30 sec in the first anodization stage, as described in Example 24, and subsequently anodized as described in Example 1 is coated with the following solution in order to produce an electrophotographic offset printing plate:

10.00 parts by weight of 2,5-bis(4'-diethylaminophenyl)-1,3,4-oxadiazole, 10.00 parts by weight of a copolymer of styrene and maleic anhydride having a softening point of 210° C., 0.02 part by weight of Rhodamine FB (C.I. 45 170), and 300.00 parts by weight of ethylene glycol monomethyl ether.

The layer is negatively charged to about 400 V in the dark by means of a corona. The charged plate is exposed imagewise in a process camera and then developed with an electrophotographic suspension developer which comprises a dispersion of 3.0 parts by weight of magnesium sulfate in a solution of 7.5 parts by weight of pentaertythritol resin ester in 1,200 parts by volume of an isoparaffin mixture having a boiling range from 185° to 210° C. After the excess developer liquid has been removed, the developer is fixed and the plate is immersed for 60 seconds in a solution comprising:

35 parts by weight of sodium metasilicate.$9H_2O$, 140 parts by weight of glycerol, 550 parts by weight of ethylene glycol and 140 parts by weight of ethanol.

The plate is then rinsed with a strong jet of water to remove those area of the photoconductor layer which are not covered with toner. The plate is then ready for printing.

EXAMPLE 31

An aluminum web prepared as described in Example 3 is subjected to a further treatment step (additional hydrophilization) by being immersed for 20 seconds in a 0.2% strength aqueous solution of polyvinylphosphonic acid at 50° C. After drying, the base additionally hydrophilized in this manner is processed further as described in Example 3, and the ink-repellent action of the non-image areas can be improved. Hydrophilization which is still more advantageous is achieved using the complex-type reaction products described in German Offenlegungsschrift No. 31 26 636, which include (a) polymers such as polyvinylphosphonic acid and (b) a salt of a metal cation which is at least divalent.

The foregoing description has been set forth merely to illustrate the invention and is not intended to be limiting. Since modifications of the described embodiments incorporating the spirit and substance of the invention may occur to persons skilled in the art, the scope of the invention is to be limited solely with respect to the appended claims and equivalents.

I claim:

1. A process for producing a base for an offset printing plate comprising the steps of:

subjecting a base material selected from aluminum and aluminum alloys to at least one roughening treatment selected from chemical roughening, mechanical roughening and electrochemical roughening to produce a roughened base material;

anodically oxidizing said roughened base material in a first stage in an aqueous $H_3PO_4$-free electrolyte in a concentration range from about 5 to 500 g/l comprising dissolved phosphoroxo-anions for a period from about 1 to about 60 seconds, at a voltage from about 10 to about 100 volts and at a temperature from about 10° to about 80° C., until a first stage oxide layer from about 0.4 to 1.4 g/m$^2$ is attained; and thereafter further anodically oxidzing the first stage oxidized base material in a second stage in an aqueous electrolyte in a concentration from about 100 g/l to 250 g/l $H_2SO_4$ and at at least 5 g/l $Al^{3+}$ ions at a temperature from about 20° to 60° C. until a total oxide layer which is thicker than said first stage oxide layer and has a layer weight of up to 3 $g/m^2$ is attained.

2. The process as claimed in claim 1, wherein said first stage is carried out for a period of about 5 to 60 seconds, at a voltage between about 20 and 80 volts and at a temperature of about 15° to 60° C.

3. The process as claimed in claim 1, wherein said aqueous electrolyte of said first stage comprises a slat having a cation selected from alkali metal, alkaline earth metal and ammonium cations and a phosphoroxo anion.

4. The process as claimed in claim 1, wherein the aqueous electrolyte of said first stage comprises from about 10 to about 200 g/l of a phosphoroxo compound.

5. The process as claimed in claim 1, wherein the aluminum is roughened electrochemically or mechanically and electrochemically.

6. The proces as claimed in claim 1, wherein said second stage is carried out for a period of about 5 to 60 seconds.

7. The process as claimed in claim 1, wherein the process is performed continuously.

8. The process as claimed in claim 1, further comprising the step of hydrophilizing the anodically oxidized base material after said second stage.

9. The process as claimed in claim 1, further comprising the step of precleaning said base material prior to said roughening step.

10. The process as claimed in claim 1, comprising the further step of rinsing said base material subsequent to said first stage and prior to said second stage.

11. The process as claimed in claim 1, wherein said anodic oxidation steps are performed using d.c. current.

12. A base for offset printing plates in the form of a sheet, a foil or a web produced by the process of claim 1.

* * * * *

UNITED STATES PATENT AND TRADEMARK OFFICE

CERTIFICATE OF CORRECTION

PATENT NO. : 4,606,975

DATED : August 19, 1986

INVENTOR(S) : Dieter MOHR

It is certified that error appears in the above-identified patent and that said Letters Patent is hereby corrected as shown below:

COLUMN 15, Line 1, "oxidzing" should read --oxidizing--;

COLUMN 15, Line 14, "slat" should read --salt--.

Signed and Sealed this

Tenth Day of February, 1987

*Attest:*

DONALD J. QUIGG

*Attesting Officer*

*Commissioner of Patents and Trademarks*